US009662902B2

(12) United States Patent
Anzai et al.

(10) Patent No.: US 9,662,902 B2
(45) Date of Patent: May 30, 2017

(54) MEDIUM SUPPORTING UNIT, RECORDING APPARATUS, AND MEDIUM SUPPORTING METHOD

(71) Applicant: SEIKO EPSON CORPORATION, Tokyo (JP)

(72) Inventors: Sumito Anzai, Shiojiri (JP); Norihiro Yamashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/054,338

(22) Filed: Feb. 26, 2016

(65) Prior Publication Data

US 2016/0271982 A1 Sep. 22, 2016

(30) Foreign Application Priority Data

Mar. 20, 2015 (JP) ..... 2015-057864

(51) Int. Cl.

| | |
|---|---|
| ***B41J 29/06*** | (2006.01) |
| ***B41J 3/407*** | (2006.01) |
| ***B41J 11/00*** | (2006.01) |
| ***B41J 11/06*** | (2006.01) |

(52) U.S. Cl.

CPC ..... *B41J 11/00* (2013.01); *B41J 3/4073* (2013.01); *B41J 3/4078* (2013.01); *B41J 11/06* (2013.01)

(58) Field of Classification Search

CPC . B41J 11/00; B41J 11/06; B41J 3/4073; B41J 3/4078

See application file for complete search history.

(56) References Cited

U.S. PATENT DOCUMENTS

| | | | | |
|---|---|---|---|---|
| 2001/0007227 | A1* | 7/2001 | Miyazaki | B41J 11/00 101/228 |
| 2003/0197772 | A1 | 10/2003 | Iwatsuki et al. | |
| 2011/0229241 | A1* | 9/2011 | Takahashi | B65H 75/241 400/611 |
| 2013/0104762 | A1 | 5/2013 | Yanagishita | |

FOREIGN PATENT DOCUMENTS

| | | |
|---|---|---|
| JP | 2003-312069 A | 11/2003 |
| JP | 2013-096017 A | 5/2013 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

A medium supporting unit includes a supporting portion that supports a medium and a holding portion that holds the medium that is in a state of being supported by the supporting portion, and the holding portion includes a first portion that is a portion at one side of a straight line passing on a center of the holding portion in a plan view of the holding portion, and a second portion that is a portion at the another side of the straight line, a weight of the first portion being different from a weight of the second portion. This configuration of the medium supporting unit enables suppression of floating of the medium without impairing the ease of handling of the medium supporting unit.

17 Claims, 9 Drawing Sheets

10
17
18
20
24
A
B
C
E

MEDIUM SUPPORTING UNIT, RECORDING APPARATUS, AND MEDIUM SUPPORTING METHOD

BACKGROUND

1. Technical Field

The present invention relates to a medium supporting unit, a recording apparatus, and a medium supporting method.

2. Related Art

Heretofore, medium supporting units provided with a holding portion capable of holding a medium supported by a supporting portion have been widely used. This configuration in which a holding portion holds a medium makes it possible to set the medium in a state in which the medium is suppressed from floating.

For example, in JP-A-2003-312069, there is disclosed a medium supporting unit that includes a platen (a supporting portion) and a frame (a holding portion) capable of rotating relative to the platen and that is capable of supporting a medium by causing the frame to hold the medium that is in a state of being supported by the platen.

Nowadays, there have been used various types of media that are each required to be supported by a medium supporting unit, and in the case where the holding force of a holding portion is insufficient, there occurs a case in which some types of such media are difficult to be set in a state of being suppressed from floating. For example, in the case where a medium containing a portion composed of a material different from a material of the other portion of the medium is used, there is a case in which the relevant portion of the medium is more likely to float as compared with the other portion of the medium. In such a case, there occurs a case in which such a medium is difficult to be set in a state of being suppressed from floating. Moreover, in some of applications of such a medium supporting unit, there occurs a case in which one side of the relevant medium supporting unit is more likely to cause floating of a medium as compared with another side of the relevant medium supporting unit.

Thus, in order to set a medium in a state where the medium is suppressed from floating in such a medium supporting unit, a method of making the weight of the holding portion large is conceived, but this method leads to impairing of the ease of handling of the medium supporting unit. In addition, in the above medium supporting unit disclosed in JP-A-2003-312069, there is no description and suggestion relating to the weight and the weight balance of the frame as the holding portion.

SUMMARY

An advantage of some aspects of the invention is that, in a medium supporting unit provided with a holding portion capable of holding a medium that is in a state of being supported by a supporting portion, it becomes possible to suppress floating of the medium without impairing the ease of handling of the medium supporting unit.

A medium supporting unit according to a first aspect of the invention includes a supporting portion that supports a medium and a holding portion that holds the medium that is in a state of being supported by the supporting portion, and the holding portion includes a first portion that is a portion at one side of a straight line passing on a center of the holding portion in a plan view of the holding portion, and a second portion that is a portion at the another side of the straight line, a weight of the first portion being different from a weight of the second portion.

A medium supporting unit according to a second aspect of the invention is configured such that, in the first aspect, the holding portion rotates relative to the supporting portion about a base rotate axis that is located at a second portion-side, and the weight of the first portion is larger than the weight of the second portion.

A medium supporting unit according to a third aspect of the invention is configured such that, in the first aspect, the holding portion rotates relative to the supporting portion about a base rotate axis that is located at a second portion-side, and the weight of the second portion is larger than the weight of the first portion.

A medium supporting unit according to a fourth aspect of the invention is configured such that, in any one of the first to third aspects, the holding portion is hitched to the supporting portion at the second portion-side and rotates relative to the supporting portion about a base rotate axis that is located at a position of the hitch.

A medium supporting unit according to a fifth aspect of the invention is configured such that, in any one of the first to third aspects, the holding portion is fixed to the supporting portion at the second portion-side so as to be rotatable relative to the supporting portion.

A medium supporting unit according to a sixth aspect of the invention is configured such that, in any one of the first to fifth aspects, a portion having a larger weight out of the first portion and the second portion has a larger volume than a portion having a smaller weight out of the first portion and the second portion.

A medium supporting unit according to a seventh aspect of the invention is configured such that, in any one of the first to sixth aspects, a portion having a larger weight out of the first portion and the second portion contains a portion having a larger specific gravity than a specific gravity of a portion having a smaller weight out of the first portion and the second portion.

A medium supporting unit according to an eighth aspect of the invention is configured such that, in any one of the first to seventh aspects, the holding portion includes a weight whose location on the holding portion is changeable, and a portion which is one of the first portion and the second portion and at which the weight is located constitutes a portion having a larger weight out of the first portion and the second portion.

A recording apparatus according to a ninth aspect of the invention includes the medium supporting unit according to any one of the first to eighth aspects, and a recording portion that performs recording on a medium that is in a state of being supported by the relevant medium supporting unit.

A medium supporting method according to a tenth aspect of the invention is a medium supporting method for a medium supporting unit including a supporting portion that supports a medium and a holding portion that holds the medium that is in a state of being supported by the supporting portion. Further, the medium supporting method includes supporting the medium by the supporting portion including the holding portion provided with a first portion that is a portion at one side of a straight line passing on a center of the holding portion in a plan view of the holding portion, and a second portion that is a portion at the another side of the straight line, a weight of the first portion being different from a weight of the second portion.

According to the above first to tenth aspects of the invention, in a medium supporting unit provided with a holding portion that holds a medium supported by a supporting portion, it is possible to suppress floating of the medium without impairing the ease of handling of the medium supporting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1 (FIGS. 1 to 4 and FIGS. 5A and 5B)

Hereinafter, a medium supporting unit 2 according to embodiment 1 and a recording apparatus 1 according to embodiment 1 and including the medium supporting unit 2 will be described in detail with reference to some of the accompanying drawings.

First, the outline of the recording apparatus 1 according to this embodiment will be described.

Figure 1:
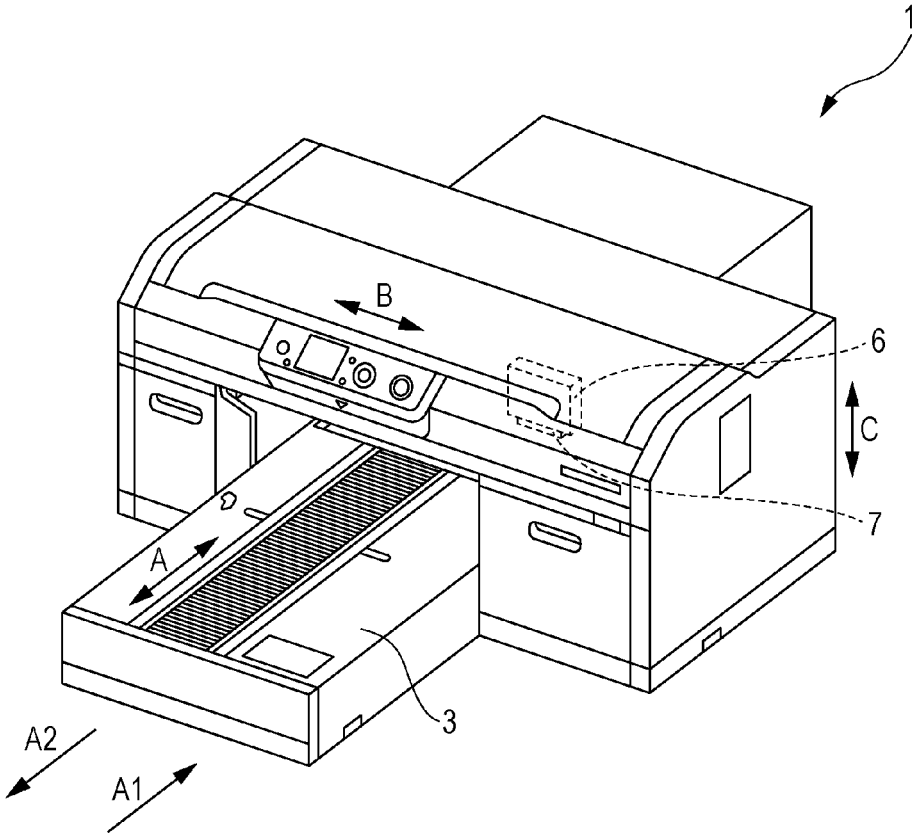
FIG. 1 is a schematic perspective view of a recording apparatus according to embodiment 1 of the invention.
Figure 2:
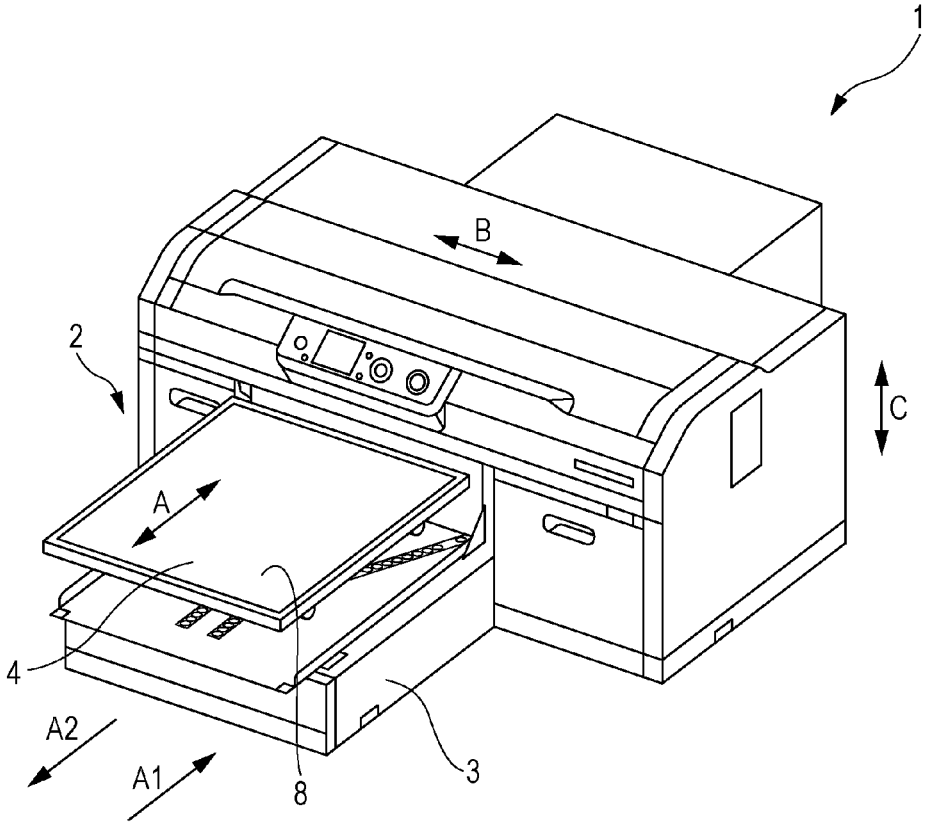
FIG. 2 is a schematic perspective view of a recording apparatus according to embodiment 1 of the invention.
Figure 3:
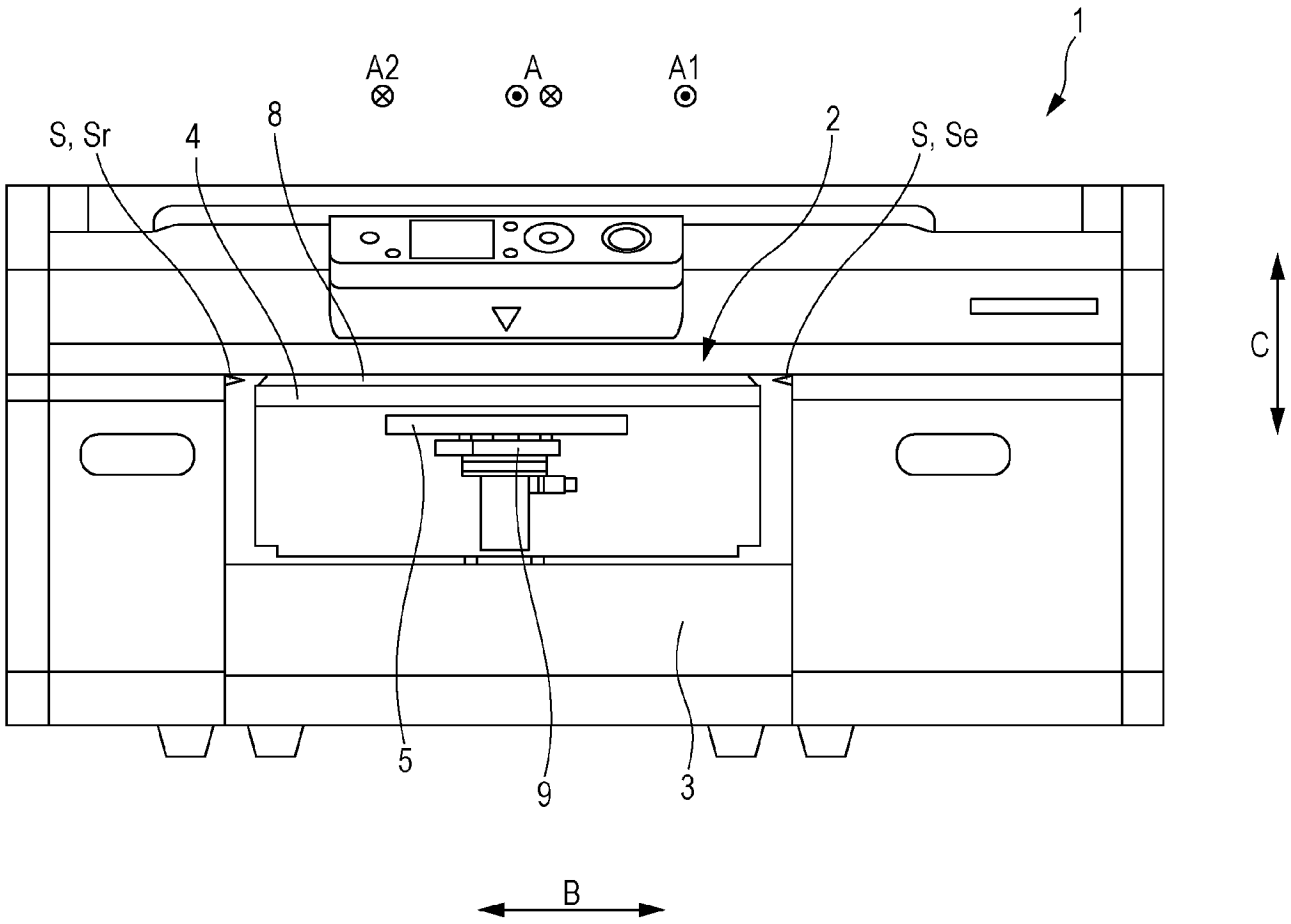
FIG. 3 is a schematic front view of a recording apparatus according to embodiment 1 of the invention.

FIGS. 1 and 2 are schematic perspective views of the recording apparatus 1 according to an embodiment of the invention; FIG. 1 out of them illustrates a state in which a tray 4 that functions as a supporting portion for supporting a medium M (refer to FIG. 4) in the recording apparatus 1 according to this embodiment is located at a recording start position; and FIG. 2 illustrates a state in which the tray 4 is located at a setting position at which the medium M is set onto the tray 4. Further, FIG. 3 is a schematic front view of the recording apparatus 1 according to this embodiment.

The recording apparatus 1 according to this embodiment includes a medium supporting unit 2 that causes the medium M to move in a movement direction A in a state in which the medium M is supported on a supporting face 8 of the tray 4. The movement direction A is a direction including a direction A1 and a direction A2 that is a direction opposite the direction A1. The medium supporting unit 2 includes the tray 4 that is a supporting portion for supporting the medium M. The recording medium 1 includes a medium transport portion 3 that transports the medium M, which is in a state of being supported by the tray 4, in the movement direction A. Further, the tray 4 is mounted on a stage 5. The tray 4 moves together with the stage 5 in a height direction C in conjunction with the rotation of a rotation lever 9. In addition, any one of various materials, such as textiles (cloth, web, and the like), paper, and a vinyl chloride resin, can be used as the medium M.

Further, a recording head 7 capable of recording on the medium M by discharging ink onto the medium M is included inside the body of the recording apparatus 1. In this embodiment, the recording head 7 corresponds to the above recording portion that performs recording on a medium. Further, the recording apparatus 1 according to this embodiment forms a user's desired image by discharging ink onto the medium M, which is in a state of being supported by the tray 4, from the recording head 7 that is caused to reciprocate together with a carriage 6 provided with the recording head 7 in an intersection direction B intersecting the movement direction A.

In addition, with respect to the recording apparatus 1 according to this embodiment, a front side (a lower left side) in each of FIGS. 1 and 2 is a setting position at which the medium M is set onto the tray 4 and which corresponds to the setting position illustrated in FIG. 2. Further, after the tray 4, on which the medium M has been set in the direction A1 constituting the movement direction A, has been moved to a recording start position, which is located at a depth side (an upper right side) in each of FIGS. 1 and 2 and which corresponds to the recording start position illustrated in FIG. 1, a recording operation is performed in conjunction with the movement of the tray 4 in the direction A2 constituting the movement direction A.

In addition, the recording apparatus 1 according to this embodiment includes the recording head 7 that executes a recording process while reciprocating in the intersection direction B, but may be a recording apparatus provided with a so-called line head in which a plurality of nozzles, through each of which ink is discharged, are formed in the intersection direction B intersecting the movement direction A.

Here, the "line head" is a recording head that is for use in a recording apparatus, which forms an image by causing one of the recording head and the medium M to move relative to the another of the recording head and the medium M, and that is installed in the recording apparatus such that the region of the nozzles, which are formed in the intersection direction B intersecting the movement direction A of the medium M, is able to cover the whole of an intersection-direction B area of the medium M. In addition, the region of the nozzles that are provided in the line head and that are formed in the intersection direction B may not necessarily be able to cover the whole of the intersection-direction B area, in all types of the medium M, which are supported by the recording apparatus.

Further, the recording head 7 according to this embodiment is a recording portion capable of performing recording by discharging ink onto the medium M, but is not limited to this type of recording portion, and, for example, a transfer type recording portion that performs recording by transferring a color material onto the medium M may be used.

Further, as shown in FIG. 3, the recording apparatus 1 according to this embodiment includes a sensor S, and is configured to be capable of detecting the presence or absence of an abnormal state in the distance between the recording head 7 and the medium M supported by the tray 4 by using the sensor S (the abnormal state being a state in which the distance between the recording head 7 and the medium M is insufficient).

Here, the sensor S is constituted by a light emitting portion Se and a light receiving portion Sr. Further, the sensor S is configured to emit light toward the light receiving portion Sr from the light emitting portion Se and detect the presence or absence of the abnormal state in the relevant distance on the basis of whether or not the light receiving portion Sr has received the relevant emitted light. In this regard, however, the configuration of the sensor is not limited to this configuration.

Next, the medium supporting unit 2 according to embodiment 1 of the invention will be described in detail.

Figure 4:
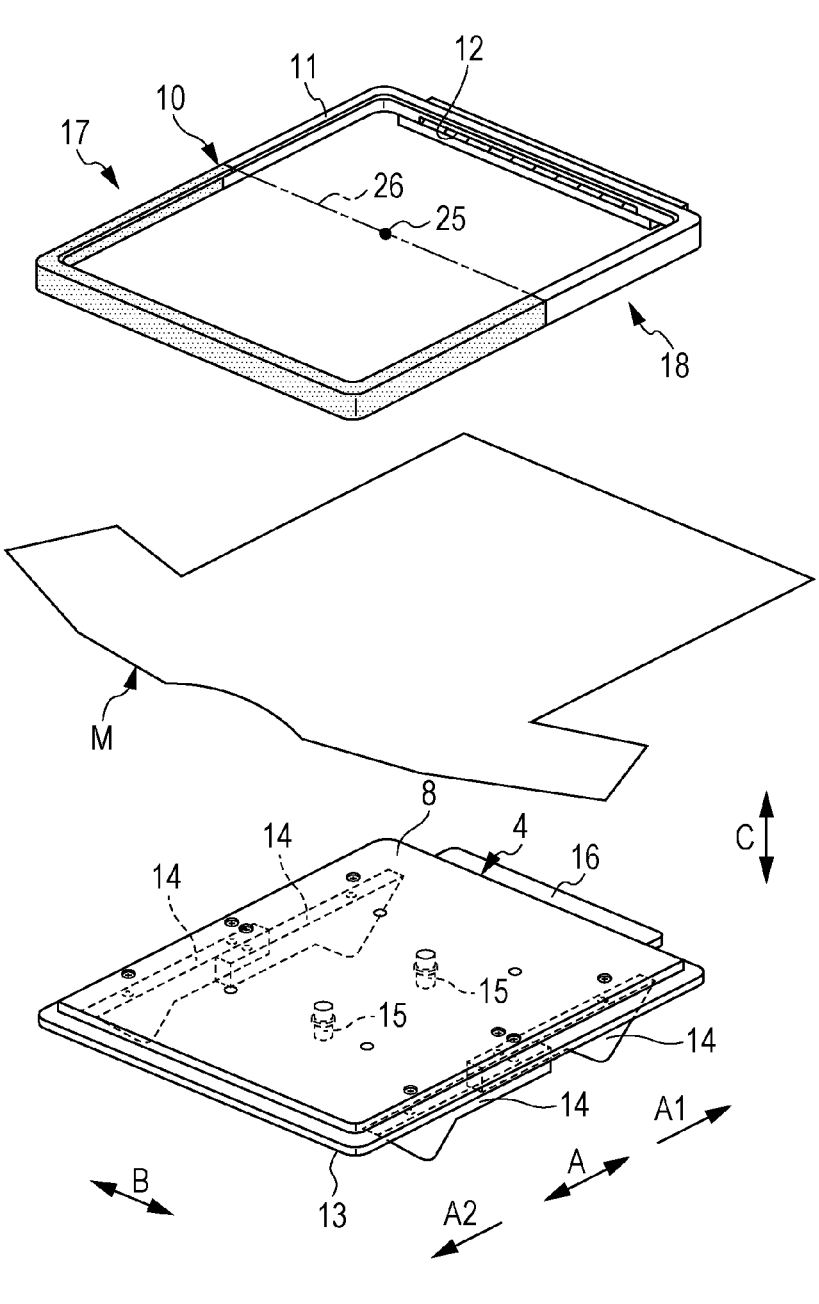
FIG. 4 is a schematic perspective view illustrating a medium supporting unit according to embodiment 1 of the invention.
Figure 5A:
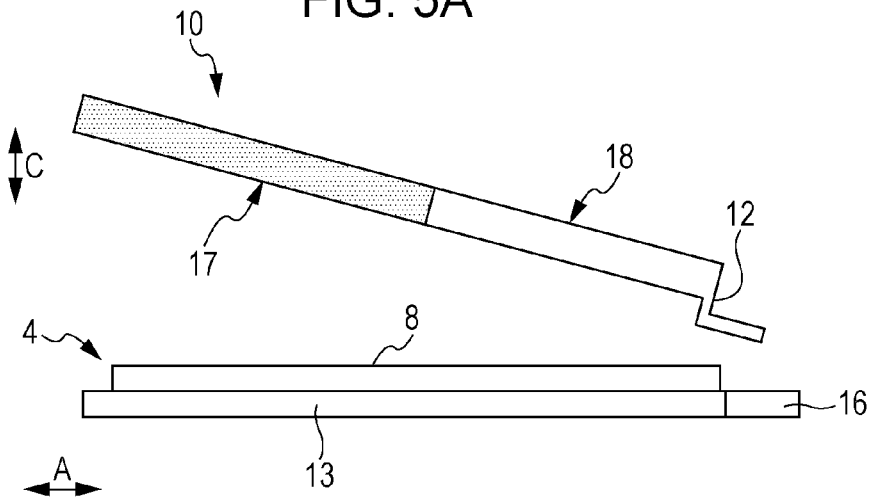
FIGS. 5A and 5B are schematic side views illustrating a medium supporting unit according to embodiment 1 of the invention.
Figure 5B:
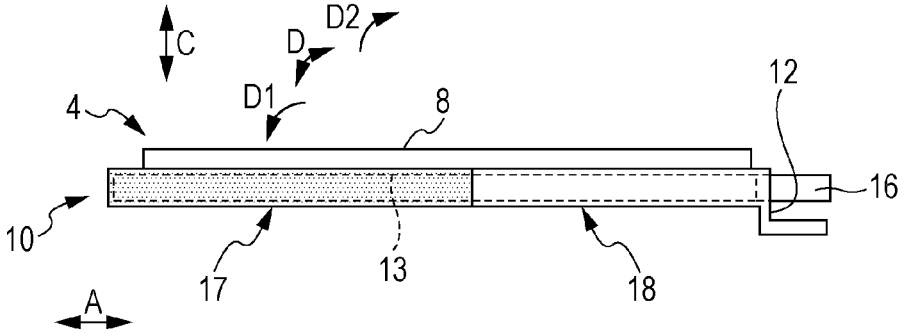

Here, FIG. 4 is a schematic perspective view illustrating the medium supporting unit 2 according to this embodiment. Further, FIGS. 5A and 5B are schematic side views illustrating the medium supporting unit 2 according to this embodiment. In addition, FIG. 5A out of them illustrates a state of the medium supporting unit 2, in which a holding portion 10 is detached from the tray 4. Further, FIG. 5B illustrates a state of the medium supporting unit 2, in which the holding portion 10 is attached to the tray 4 in a state in which the medium M is not supported by the tray 4.

As shown in FIGS. 4 and 5, the medium supporting unit 2 according to this embodiment includes the tray 4 functioning as a supporting portion capable of supporting the medium M, and the holding portion 10 being of a frame shape and being capable of holding the medium that is in a state of being supported by the tray 4.

Further, the medium supporting unit 2 according to this embodiment is configured to become capable of holding the medium M by using the holding portion 10 by producing a state in which the supporting face 8 of the tray 4 is capable of supporting the medium M thereon and an eave portion 11 of the holding portion 10 is capable of being placed on an edge portion 13 of the tray 4. Further, a protruding portion 16 is provided at a head side of the tray 4 in the direction A1, and an opening portion 12 is provided at a head side of the holding portion 10 in the direction A1. Further, as shown in FIG. 5B, it is possible to attach the holding portion 10 to the tray 4 by inserting the protruding portion 16 into the opening portion 12, and in a state in which the holding portion 10 is attached to the tray 4, it is possible to cause the holding portion 10 to rotate in a rotate direction D relative to the tray 4 about a base rotate axis that is located at a portion at which the protruding portion 16 and the opening portion 12 are joined to each other.

Further, as shown in FIG. 4, the holding portion 10 according to this embodiment includes a first portion 17 that is a portion at one side of a straight line 26 passing on a center 25 of the holding portion 10 in a plan view of the holding portion 10, and a second portion 18 that is a portion at the another side of the straight line 26. In other words, the first portion 17 is a portion that is located farther from the opening portion 12 than the center 25 of the holding portion 10 in a plan view of the holding portion 10, and the second portion 18 is a portion that is located nearer the opening portion 12 than the center 25 of the holding portion 10 in the plan view of the holding portion 10. Further, in this embodiment, the holding portion 10 is divided into two portions in a longitudinal direction of the holding portion 10 and thereby the two divided portions, that is, the first portion 17 and the second portion 18, are distinguished from each other.

Further, the weight of the first portion 17 and the weight of the second portion 18 are different from each other.

That is, the weight of a portion constituting the holding portion 10 and being located at one side thereof at which the medium M is likely to float is made large, and the weight of a portion constituting the holding portion 10 and being located at the another side thereof at which the medium M is unlikely to float is made small. Further, the medium M is suppressed from floating in a state in which excessive increase of the weight of the entire holding portion 10 is suppressed. Accordingly, the medium supporting unit 2 is configured to be capable of suppressing floating of the medium M without impairing the ease of handling of the medium supporting unit 2.

Further, in other words, the printing apparatus 1 according to this embodiment is configured to be capable of performing recording in a state in which the medium M is suppressed from floating without impairing the ease of handling of the medium supporting unit 2.

In addition, "the center of the holding portion 10 in a plan view of the holding portion 10" means a center of the holding portion 10 when the holding portion 10 is viewed in a direction perpendicular to the supporting face 8 of the tray 4.

Moreover, in further other words, it is possible to suppress floating of the medium M without impairing the ease of handling of the medium supporting unit 2 by supporting the medium M by using the medium supporting unit 2 including the holding portion 10 provided with the first portion 17 that is a portion at one side of the straight line 26 passing on the center 25 of the holding portion 10 in a plan view of the holding portion 10, and the second portion 18 that is a portion at the another side of the straight line 26, the weight of the first portion 17 being different from the weight of the second portion 18.

Further, as shown in FIG. 5B, the medium supporting unit 2 according to this embodiment is configured such that, in a state in which the holding portion 10 is attached to the tray 4, the holding portion 10 is capable of rotating in the rotate direction D relative to the tray 4 about a base rotate axis that is located on a portion where the protruding portion 16 and the opening portion 12 are joined to each other. That is, the holding portion 10 is capable of rotating relative to the tray 4 about a base rotate axis that is located at a second portion-side 18. Further, the medium supporting unit 2 according to this embodiment is configured such that the weight of the first portion 17 is larger than the weight of the second portion 18.

Here, one side of the holding portion 10, at which a base rotate axis of rotating relative to the tray 4 is located (i.e., the second portion-side 18 in this embodiment) includes a rotate point that is fixed (that is, suppressed from moving in a direction perpendicular to the supporting face 8 of the tray 4) by the protruding portion 16 and opening portion 12, and thus, at the one side of the holding portion 10, the medium M is unlikely to float. For this reason, the medium supporting unit 2 according to this embodiment is configured to be capable of effectively suppressing floating of the medium M by making the another side of the holding portion 10, which is a side opposite the side at which the medium M is unlikely to float and which corresponds to a first portion-side 17 in this embodiment, heavier. Further, the medium supporting unit 2 according to this embodiment is configured such that, through a configuration in which one side of the holding portion 10, which is a side opposite a side at which a base rotate axis is located and corresponds to the first portion-side 17 in this embodiment, is made heavier, when bringing down the holding portion 10 toward the medium M that is in a state of being supported by the tray 4 by causing the holding portion 10 to rotate downward in a rotate direction D1 constituting the rotate direction D, a user is able to bring down the holding portion 10 with a small force, thus enabling increase of the ease of handling of the medium supporting unit 2.

Meanwhile, the medium supporting unit 2 may be configured such that the holding portion 10 is capable of rotating relative to the tray 4 about a base rotate axis that is located at the second portion-side 18, and the weight of the second portion 18 is larger than the weight of the first portion 17.

The configuration of the supporting unit 2 may be changed in accordance with the type and/or the shape of the medium M, a transport direction of the medium M when a recording operation is performed by the recording apparatus 1, and/or the like. In such a case, there is a case in which the holding force at one side of the holding portion 10, at which a base rotate axis is located and which corresponds to the second portion-side 18 in this embodiment, is required to be very large; while the holding force at the another side of the holding portion 10, which is a side opposite the side at which the base rotate axis is located and corresponds to the first portion-side 17 in this embodiment, may be small. For example, when a used medium M is composed of a soft material and is likely to swell by being supplied with ink, there is a case in which, along with recording on the medium M, the medium M swells at a downstream side in a transport direction of the medium M, and thereby a large force that causes floating of the medium M arises at the relevant downstream side. In this case, when a side at which a base rotate axis is located is made the relevant downstream side, the holding force at the side at which the base rotate axis is located is required to be very large, but the holding force at a side opposite the side at which the base rotate axis is located may be small. In such a case, through a configuration in which the side opposite the side at which the base rotate axis is located is made lighter, when bringing up the holding portion 10 in a direction in which the position of the holding portion 10 gradually becomes farther from the medium M being in a state of being supported by the tray 4 by causing the holding portion 10 to rotate upward in a rotate direction D2 constituting the rotate direction D, a user is able to bring up the holding portion 10 with a small force, thus enabling further increase of the ease of handling of the medium supporting medium 2.

Further, when the medium M is set onto the tray 4 or is brought out from the tray 4, the holding portion 10 is required to remain in an opened state. When the holding portion 10 has been brought up, it is possible to stably keep the holding portion 10 in an opened state by making the side at which a base rotate axis is located heavier. Thus, it is unnecessary to provide a damper mechanism or a lock mechanism for keeping the holding portion 10 in an opened state, thereby enabling the medium supporting unit 2 to be simply configured.

Further, as shown in FIGS. 5A and 5B, the holding portion 10 according to this embodiment is capable of being hitched to the tray 4 at the second portion-side 18 (that is, the opening portion 12 of the holding portion 10 is capable of being hitched to the protruding portion 16 of the tray 4), and is capable of rotating relative to the tray 4 about a base rotate axis that is located at the position of the hitch.

The medium supporting unit 2 according to this embodiment is configured in such a manner as described above, and thus is provided with a rotate point that produces a state in which the medium M is unlikely to float without additionally providing any particular component for coupling.

Further, in the medium supporting unit 2 according to this embodiment, the first portion 17 is composed of an iron material and the second portion 18 is composed of an aluminum material. That is, a portion having a larger weight out of the first portion 17 and the second portion 18 contains a portion having a larger specific gravity than that of a portion having a smaller weight out of the first portion 17 and the second portion 18. In this way, it is possible to easily produce an unbalanced weight state (that is, it is possible to easily constitute the first portion 17 and the second portion 18) by constituting at least part of a half portion at one side of the holding portion 10 by using a member whose specific gravity is larger than that of a member constituting a half portion at the another side of the holding portion 10. In addition, the constituent materials of the first portion 17 and the second portion 18 are not limited to particular materials and, in addition to the iron material and the aluminum material, for example, a lead material heavier than the iron material, a plastic material (a resin material) lighter than the aluminum material can be employed.

In addition, as shown in FIG. 4, the tray 4 according to this embodiment includes placing portions 14 for use in placing the tray 4 having been detached from the stage 5 on a floor or the like, and positioning portions 15 capable of positioning of the tray 4 relative to the stage 5. In this regard, however, the configuration of the tray 4 is not particularly limited by these members.

Figure 6A:
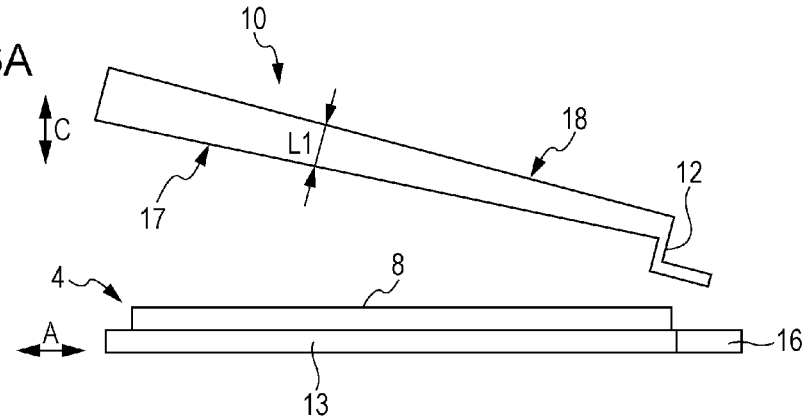
FIGS. 6A, 6B, and 6C are schematic diagrams illustrating a medium supporting unit according to embodiment 2 of the invention.
Figure 6B:
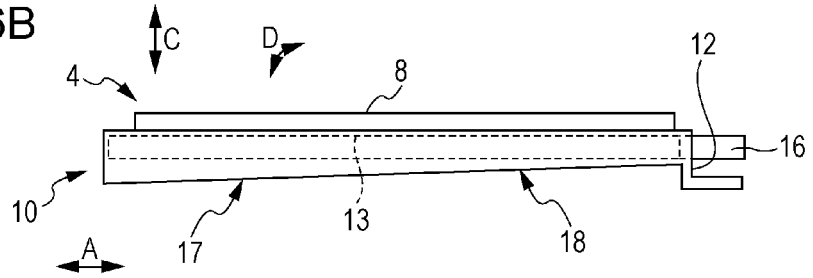
Figure 6C:
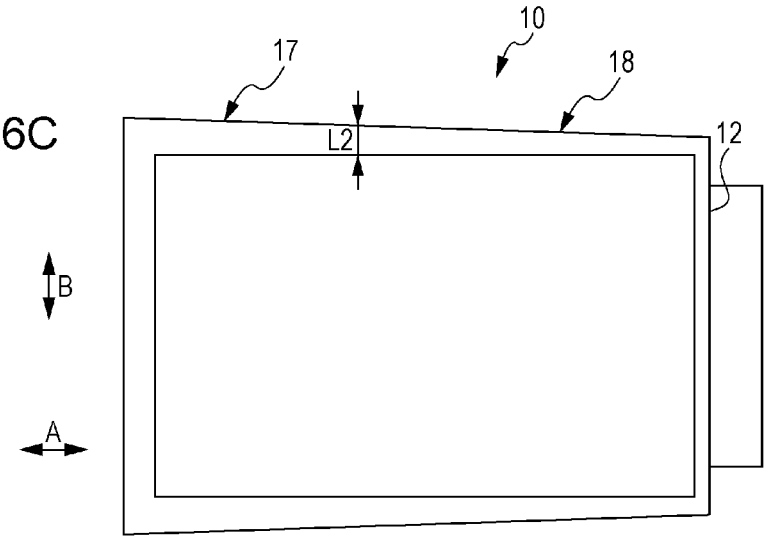

Embodiment 2 (FIGS. 6A to 6C)

Next, a medium supporting unit 2 according to embodiment 2 of the invention will be described.

FIGS. 6A, 6B, and 6C are schematic diagrams illustrating a medium supporting unit 2 according to this embodiment and being usable in the recording apparatus 1 according to embodiment 1. FIG. 6A among them is a schematic side view corresponding to FIG. 5A in embodiment 1; and FIG. 6B among them is a schematic side view corresponding to FIG. 5B in embodiment 1. Further, FIG. 6C is a schematic plan view. In addition, constituent members common to constituent members of embodiment 1 described above will be denoted by the same reference signs as those of the constituent members of embodiment 1, and detailed description thereof will be omitted.

The medium supporting unit 2 according to this embodiment is different from the medium supporting unit 2 according to embodiment 1 only in the configuration of a holding portion 10.

As described above, the medium supporting unit 2 according to embodiment 1 is configured such that the first portion 17 is composed of an iron material and the second portion 18 is composed of an aluminum material, that is, a portion having a larger weight out of the first portion 17 and the second portion 18 contains a portion having a larger specific gravity than that of a portion having a smaller weight out of the first portion 17 and the second portion 18.

Meanwhile, in the medium supporting unit 2 according to this embodiment, both of a first portion 17 and a second portion 18 are composed of an iron material.

Specifically, the holding portion 10 according to this embodiment is configured such that the first portion 17 that is a portion having a larger weight out of the first portion 17 and the second portion 18 has a larger volume than that of a portion having a smaller weight out of the first portion 17 and the second portion 18. In this way, an unbalanced weight state in the first portion 17 and the second portion 18 is easily produced by making the volume of a half portion at one side of the holding portion 10 larger than that of a half portion at the another side of the holding portion 10.

In addition, the holding portion 10 according to this embodiment is configured such that both of a thickness L1 and a width L2 increase as an observation point on the holding portion 10 moves in a direction from a side of an opening portion 12, at which a base rotate axis is located, toward a side opposite the side of the opening portion 12. The holding portion 10 according to this embodiment, however, is not limited to this configuration, and may be configured such that only any one of the thickness L1 and the width L2 increases as an observation point on the holding portion 10 moves in the direction from the side of the opening portion 12, at which a base rotate axis is located, toward the side opposite the side of the opening portion 12.

Further, in the case where the weight of the second portion 18 is made larger than that of the first portion 17, it is enough just to make the volume of the second portion 18 larger than that of the first portion 17. Specifically, this configuration is such that at least one of the thickness L1 and the width L2 increases as an observation point on the holding portion 10 moves in a direction from a side opposite a base rotate axis side toward the base rotate axis side.

Figure 7A:
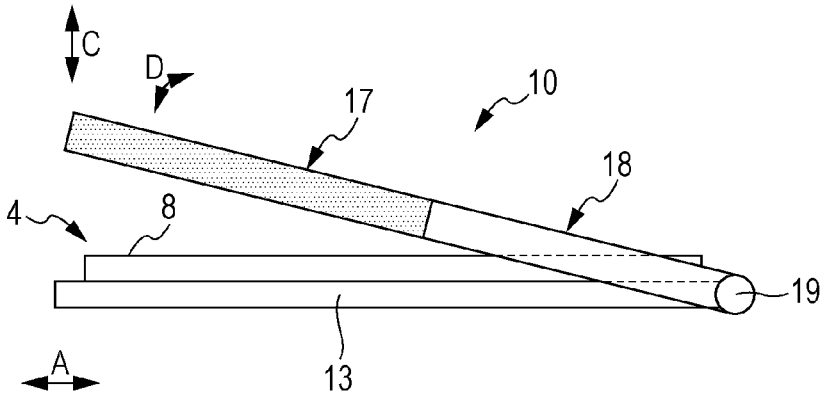
FIGS. 7A and 7B are schematic side views illustrating a medium supporting unit according to embodiment 3 of the invention.
Figure 7B:
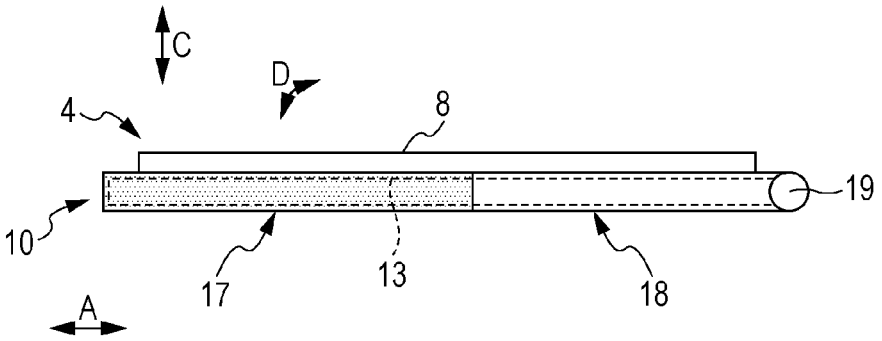

Embodiment 3 (FIGS. 7A and 7B)

Next, a medium supporting unit 2 according to embodiment 3 of the invention will be described.

FIGS. 7A and 7B are schematic diagrams illustrating a medium supporting unit 2 according to this embodiment and being usable in the recording apparatus 1 according to embodiment 1. FIG. 7A out of them is a schematic side view corresponding to FIG. 5A in embodiment 1; and FIG. 7B out of them is a schematic side view corresponding to FIG. 5B in embodiment 1. In addition, constituent members common to constituent members of embodiments 1 and 2 described above will be denoted by the same reference signs as those of the constituent members of embodiments 1 and 2, and detailed description thereof will be omitted.

The medium supporting unit 2 according to this embodiment is different from the medium supporting unit 2 according to embodiment 1 only in the configuration of a mechanism for rotating of a holding portion 10 relative to a tray 4.

As described above, the medium supporting unit 2 according to embodiment 1 is configured such that the opening portion 12 of the holding portion 10 is capable of being hitched to the protruding portion 16 of the tray 4 at the second portion-side 18, and the holding portion 10 is rotatable in the rotate direction D relative to the tray 4 about a base rotate axis that is located at the position of the hitch.

Meanwhile, the medium supporting unit 2 according to this embodiment is configured such that a hinge 19 is provided at a side of a second portion 18, and the holding portion 10 is rotatable in a rotate direction D relative to the tray 4 about a base rotate axis that is located on the hinge 19.

In other words, the medium supporting unit 2 according to this embodiment is fixed to the tray 4 at the second portion-side 18 so as to be rotatable relative to the tray 4. Further, through this configuration, a rotate point that produces a state in which the medium M is unlikely to float is easily realized.

Figure 8A:
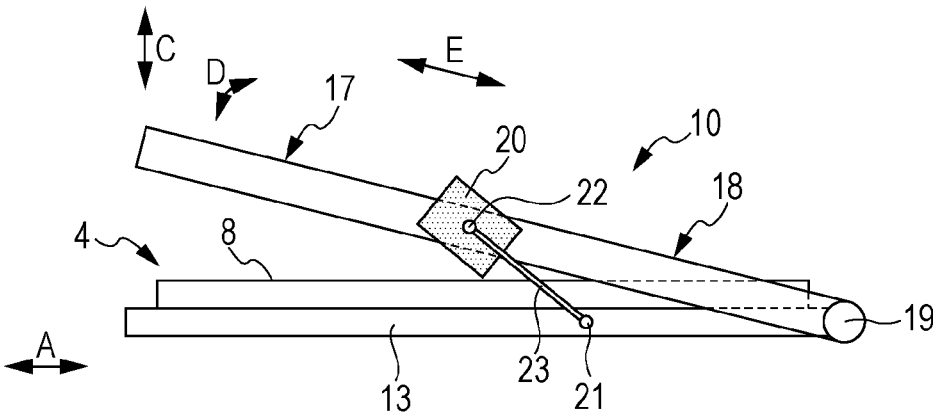
FIGS. 8A and 8B are schematic side views illustrating a medium supporting unit according to embodiment 4 of the invention.
Figure 8B:
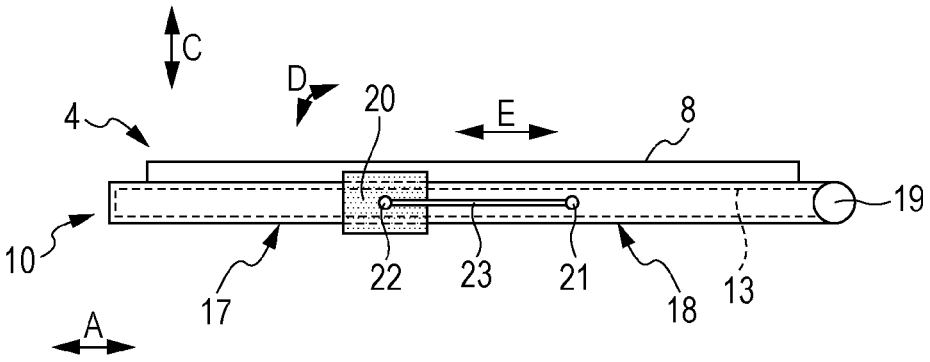

Embodiment 4 (FIGS. 8A and 8B)

Next, a medium supporting unit 2 according to embodiment 4 of the invention will be described.

FIGS. 8A and 8B are schematic diagrams illustrating a medium supporting unit 2 according to this embodiment and being usable in the recording apparatus 1 according to embodiment 1. FIG. 8A out of them is a schematic side view corresponding to FIG. 5A in embodiment 1; and FIG. 8B out of them is a schematic side view corresponding to FIG. 5B in embodiment 1. In addition, constituent members common to constituent members of embodiments 1 to 3 described above will be denoted by the same reference signs as those of the constituent members of embodiments 1 to 3, and detailed description thereof will be omitted.

The medium supporting unit 2 according to this embodiment is configured such that, just like the medium supporting unit 2 according to embodiment 3, a hinge 19 is provided at a side of a second portion 18, and a holding portion 10 is rotatable in a rotate direction D relative to a tray 4 about a base rotate axis that is located on the hinge 19. Further, the holding portion 10 is composed of an iron material, and is provided with a weight 20 capable of moving in a direction E in conjunction with rotating of the holding portion 10 in a rotate direction D. Further, as shown in FIG. 8B, a first portion 17, which is a portion having a larger weight out of the first portion 17 and the second portion 18, is constituted by causing the weight 20 to be located at a first portion-side 17.

Specifically, the weight 20 being provided on the holding portion 10 and including a connection portion 22 connected to one end of a bar-shaped member 23, the another end of which is connected to a connection portion 21 of the tray 4, is configured to move toward the second portion-side 18 when the holding portion 10 is opened relative to the tray 4, and move toward the side of first portion 17 when the holding portion 10 is closed relative to the tray 4.

Through this configuration of the medium supporting unit 2 according to this embodiment, it is possible to, along with opening/closing of the holding portion 10 relative to the tray 4, easily produce an unbalanced weight state (that is, it is possible to easily constitute the first portion 17 and the second portion 18).

In addition, the medium supporting unit 2 according to this embodiment is configured to be capable of automatically producing an unbalanced weight state in conjunction with opening/closing of the holding portion 10 relative to the tray 4, but may be configured such that the bar-shaped member 23 and the connection portions 21 and 22 are omitted and it is made possible that an operator locates the weight 20 at his or her intended position. That is, this configuration is such that the weight 20 is attachable/detachable to/from the holding portion 10. The weight 20 may be attached to the holding portion 10 by using any one of various attachment means, such as a magnet, a screw, and adhesive taper. Through such a configuration, it is possible to easily produce a weight unbalance state and, simultaneously therewith, easily adjust the weigh balance between the first portion 17 and the second portion 18 in accordance with the type of the medium M, the purpose of utilization of the medium supporting unit 2, and/or the like. In addition, it is possible to realize the weight 20 by using, for example, a lead material having a large specific gravity.

Embodiments 5 to 9 (FIGS. 9A to 9E)

Next, five kinds of medium supporting units 2 each according to a corresponding one of embodiments 5 to 9 of the invention will be described.

Figures 9A, 9B, 9C, 9D, 9E:
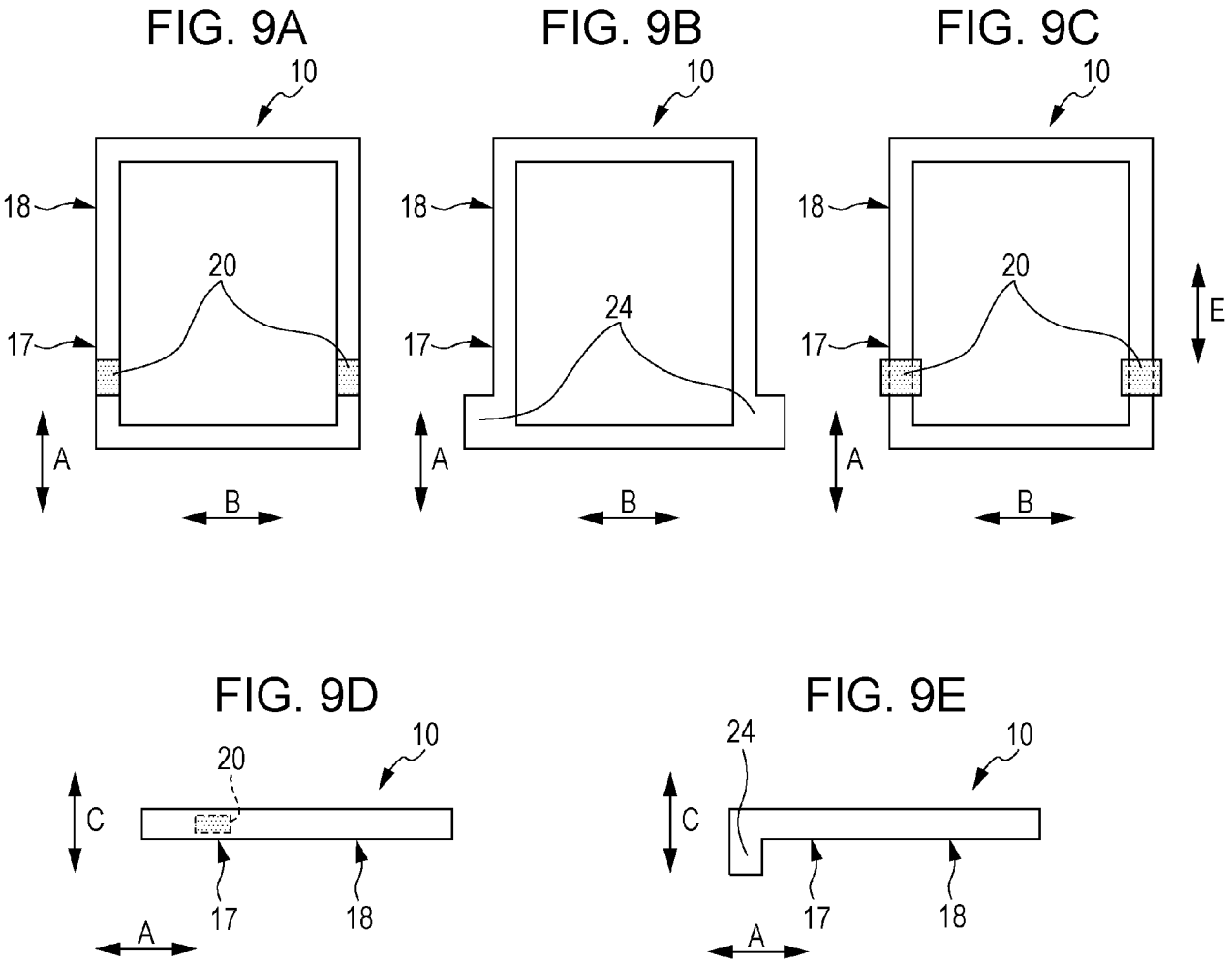
FIGS. 9A to 9E are schematic diagrams illustrating five kinds of medium supporting units according to embodiments 5 to 9 of the invention.

FIGS. 9A to 9E are simplified schematic diagrams illustrating five kinds of holding portions 10 each being included in a corresponding one of the five kinds of medium supporting units 2 according to embodiments 5 to 9 of the invention. FIGS. 9A, 9B, and 9C among them are schematic plan views in embodiments 5, 6, and 7; and FIGS. 9D and 9E among them are schematic side views in embodiments 8 and 9.

In addition, in each of embodiments 5 to 9 shown in FIGS. 9A to 9E, although omitted from illustration for the simplification of description, a corresponding one of the five kinds of holding portions 10 is configured to, just like the holding portion 10 in embodiment 1, include an opening portion 12 capable of being hitched to a protruding portion 16 of a tray 4 at a side of a second portion 18 of the relevant holding portion 10, and be capable of rotating relative to the tray 4 about a base rotate axis that is located at the position of the hitch.

Here, as shown in FIG. 9A, the holding portion 10 according to embodiment 5 is configured such that a fixed type weight 20 is provided at only part of the first portion 17.

Further, as shown in FIG. 9B, the holding portion 10 according to embodiment 6 is configured such that the width of a portion 24 of the first portion 17 is made larger.

Further, as shown in FIG. 9C, the holding portion 10 according to embodiment 7 is configured such that a moving type weight 20 capable of moving in a direction E is provided.

Further, as shown in FIG. 9D, the holding portion 10 according to embodiment 8 is configured such that a weight 20 is provided so as to be embedded in the first portion 17.

Further, as shown in FIG. 9E, the holding portion 10 according to embodiment 9 is configured such that the thickness of a portion 24 of the first portion 17 is made larger.

The holding portion 10 according to each of embodiments 1 to 9 is configured to be capable of rotating relative to the tray 4 about a rotate point that is located at the second portion-side 18 (corresponding to a portion having a smaller weight) in the first portion 17 (corresponding to a portion having a larger weight) and the second portion 18 (corresponding to the portion having a smaller weight). The holding portion 10, however, is not limited this configuration, and may be configured to be capable of rotating about a rotate point that is located at a side of a portion having a larger weight. Moreover, the configuration in which the holding portion 10 is capable of rotating relative to the tray 4 may not be employed, and a configuration in which the holding portion 10 is placed relative to the tray 4 may be employed. Further, in the case where the configuration in which the holding portion 10 is capable of rotating relative to the tray 4 is employed, in order to prevent a finger of a user to be caught between the tray 4 and the holding portion 10, a lock mechanism capable of temporarily fixing the position of the holding portion 10 relative to the tray 4, or the like, may be provided.

It is to be noted, here, that the invention is not limited to the aforementioned embodiments, and various modifications of the aforementioned embodiments can be made within a scope of appended claims, but, naturally, the modifications are included in the scope of the invention.

Hereinbefore, the invention has been described in detail on the basis of the above specific embodiments. Here, the invention will be summarized and described below once again.

A medium supporting unit 2 according to a first aspect of the invention includes a supporting portion 4 that supports a medium M and a holding portion 10 that holds the medium M that is in a state of being supported by the supporting portion 4, and the holding portion 10 includes a first portion 17 that is a portion at one side of a straight line 26 passing on a center 25 of the holding portion 10 in a plan view of the holding portion 10, and a second portion 18 that is a portion at the another side of the straight line 26, a weight of the first portion 17 being different from a weight of the second portion 18.

According to this aspect, the holding portion 10 includes the first portion 17 that is a portion at one side of the straight line 26 passing on the center 25 of the holding portion 10 in a plan view of the holding portion 10, and the second portion 18 that is a portion at the another side of the straight line 26, the weight of the first portion 17 being different from the weight of the second portion 18. That is, a half portion at one side of the holding portion 10 is made heavier than a half portion at the another side thereof. Thus, for example, the weight of a half portion, which is a half portion at one side of the holding portion 10 and at which the medium M is likely to float, is made large, and a half portion, which is a half portion at the another side of the holding portion 10 and at which the medium M is unlikely to float, is made small, thereby enabling suppression of excessive increase of the weight of the entire holding portion 10 and, simultaneously therewith, suppression of floating of the medium M. Accordingly, it becomes possible to suppress floating of the medium M without impairing the ease of handling of the medium supporting unit 2. In addition, "the center of the holding portion 10 in a plan view of the holding portion 10" means a center of the holding portion 10 when the holding portion 10 is viewed in a direction perpendicular to the supporting face 8 of the supporting portion 4.

A medium supporting unit 2 according to a second aspect of the invention is configured such that, in the first aspect, the holding portion 10 rotates relative to the supporting portion 4 about a base rotate axis that is located at a second portion-side 18, and the weight of the first portion 17 is larger than the weight of the second portion 18.

According to this aspect, the holding portion 10 rotates relative to the supporting portion 4 about a base rotate axis that is located at the second portion-side 18, and the weight of the first portion 17 is larger than the weight of the second portion 18. A side at which a base rotate axis of rotating relative to the supporting portion 4 is located (i.e., the second portion-side 18) includes a fixed rotate point, and thus, causes the medium M to be unlikely to float. Thus, it is possible to effectively suppress floating of the medium M by making a side opposite the side at which the medium M is unlikely to float heavier (that is, by making a first portion-side 17 heavier). Further, since the side opposite the side at which a base rotate axis is located is made heavier (that is, since the first portion-side 17 is made heavier), when bringing down the holding portion 10 toward the medium M that is in a state of being supported by the supporting portion 4 by causing the holding portion 10 to rotate downward, an operator is able to bring down the holding portion 10 with a small force, thus enabling increase of the ease of handling of the medium supporting unit 2.

A medium supporting unit 2 according to a third aspect of the invention is configured such that, in the first aspect, the holding portion 10 rotates relative to the supporting portion 4 about a base rotate axis that is located at a second portion-side 18, and the weight of the second portion 18 is larger than the weight of the first portion 17.

According to this aspect, the holding portion 10 rotates relative to the supporting portion 4 about a base rotate axis that is located at the second portion-side 18, and the weight of the second portion 18 is larger than the weight of the first portion 17. Thus, since the side opposite the side at which a base rotate axis is located is made lighter (that is, since the first portion-side 17 is made lighter), when bringing up the holding portion 10 in a direction in which the holding portion 10 gradually becomes farther from the medium M that is in a state of being supported by the holding portion 10 by causing the holding portion 10 to rotate upward, an operator is able to bring up the holding portion 10 with a small force, thus enabling increase of the ease of handling of the medium supporting unit 2.

A medium supporting unit 2 according to a fourth aspect of the invention is configured such that, in any one of the first to third aspects, the holding portion 10 is hitched to the supporting portion 4 at the second portion-side 18 and rotates relative to the supporting portion 4 about a base rotate axis that is located at a position of the hitch.

According to this aspect, the holding portion 10 is hitched to the supporting portion 4 at the second portion-side 18 and rotates relative to the supporting portion 4 about a base rotate axis that is located at the position of the hitch. Thus, it is possible to provide a rotate point that produces a state in which the medium M is unlikely to float without additionally providing any particular component for coupling.

A medium supporting unit 2 according to a fifth aspect of the invention is configured such that, in any one of the first to third aspects, the holding portion 10 is fixed to the supporting portion 4 at the second portion-side 18 so as to be rotatable relative to the supporting portion 4.

According to this aspect, the holding portion 10 is fixed to the supporting portion 4 at the second portion-side 18 so as to be rotatable relative to the supporting portion 4. Thus, it is possible to easily provide a rotate point that produces a state in which the medium M is unlikely to float by using, for example, the hinge 19.

A medium supporting unit 2 according to a sixth aspect of the invention is configured such that, in any one of the first to fifth aspects, a portion having a larger weight out of the first portion 17 and the second portion 18 has a larger volume than a portion having a smaller weight out of the first portion 17 and the second portion 18.

According to this aspect, a portion having a larger weight out of the first portion 17 and the second portion 18 has a larger volume than a portion having a smaller weight out of the first portion 17 and the second portion 18. Thus, it is possible to easily produce an unbalanced weight state (that is, it is possible to easily constitute the first portion 17 and the second portion 18) by making the volume of a half portion at one side of the holding portion 10 larger than the volume of a half portion at the another side of the holding portion 10.

A medium supporting unit 2 according to a seventh aspect of the invention is configured such that, in any one of the first to sixth aspects, a portion having a larger weight out of the first portion 17 and the second portion 18 contains a portion having a larger specific gravity than a specific gravity of a portion having a smaller weight out of the first portion 17 and the second portion 18.

According to this aspect, a portion having a larger weight out of the first portion 17 and the second portion 18 contains a portion having a larger specific gravity than a specific gravity of a portion having a smaller weight out of the first portion 17 and the second portion 18. Thus, it is possible to easily produce an unbalanced weight state (that is, it is possible to easily constitute the first portion 17 and the second portion 18) by constituting at least part of a half portion at one side of the holding portion 10 by using a member having a specific gravity larger than that of a half portion at the another side of the holding portion 10.

A medium supporting unit 2 according to an eighth aspect of the invention is configured such that, in any one of the first to seventh aspects, the holding portion 10 includes a weight 20 whose location on the holding portion 10 is changeable, and a portion which is one of the first portion 17 and the second portion 18 and at which the weight 20 is located constitutes a portion having a larger weight out of the first portion 17 and the second portion 18.

According to this aspect, the holding portion 10 includes a weight 20 whose location on the holding portion 10 is changeable, and a portion which is one of the first portion 17 and the second portion 18 and on which the weight 20 is located constitutes a portion having a larger weight out of the first portion 17 and the second portion 18. Thus, it is possible to easily produce a weight unbalance state (that is, it is possible to easily constitute the first portion 17 and the second portion 18) and, simultaneously therewith, easily adjust the weigh balance between the first portion 17 and the second portion 28 in accordance with, for example, the type of the medium M and/or the purpose of utilization of the medium supporting unit 2.

A recording apparatus 1 according to a ninth aspect of the invention includes the medium supporting unit 2 according to any one of the first to eighth aspects, and a recording portion that performs recording on a medium M that is in a state of being supported by the relevant medium supporting unit 2.

According to this aspect, it is possible to perform recording in a state in which the medium M is suppressed from floating without impairing the ease of handling of the medium supporting unit 2.

A medium supporting method according to a tenth aspect of the invention is a medium supporting method for a medium supporting unit 2 including a supporting portion 4 that supports a medium M and a holding portion 10 that holds the medium M that is in a state of being supported by the supporting portion 4. Further, the medium supporting method includes supporting the medium M by the supporting portion 2 including the holding portion 10 provided with a first portion 17 that is a portion at one side of a straight line 26 passing on a center 25 of the holding portion 10 in a plan view of the holding portion 10, and a second portion 18 that is a portion at the another side of the straight line 26, a weight of the first portion 17 being different from a weight of the second portion 18.

According to this aspect, the holding portion 10 includes the first portion 17 that is a portion at one side of the straight line 26 passing on the center 25 of the holding portion 10 in a plan view of the holding portion 10, and the second portion 18 that is a portion at the another side of the straight line 26, the weight of the first portion 17 being different from the weight of the second portion 18. That is, a half portion at one side of the holding portion 10 is made heavier than a half portion at the another side thereof. Thus, for example, the weight of a half portion, which is a half portion at one side of the holding portion 10 and at which the medium M is likely to float, is made large, and a half portion, which is a half portion at the another side of the holding portion 10 and at which the medium M is unlikely to float, is made small, thereby enabling suppression of excessive increase of the weight of the entire holding portion 10 and, simultaneously therewith, suppression of floating of the medium M. Accordingly, it becomes possible to suppress floating of the medium M without impairing the ease of handling of the medium supporting unit 2.

The entire disclosure of Japanese Patent Application No. 2015-057864, filed Mar. 20, 2015 is expressly incorporated reference herein.

What is claimed is:

1. A medium supporting unit comprising:

a tray shaped supporting portion that supports a medium; and a holding portion that holds the medium that is in a state of being supported by the supporting portion, wherein the holding portion includes a first portion that is a portion at one side of a straight line passing through a center of the holding portion in a plan view of the holding portion, and a second portion that is a portion at the another side of the straight line, a weight of the first portion being different from a weight of the second portion, wherein the holding portion is a frame member that surrounds the supporting portion when the medium is in the state of being supported by the supporting medium.

2. The medium supporting unit according to claim 1, wherein the holding portion rotates relative to the supporting portion about a base rotate axis that is located at a second portion-side, and the weight of the first portion is larger than the weight of the second portion.

3. A recording apparatus comprising:

the medium supporting unit according to claim 2; and a recording portion that performs recording on a medium that is in a state of being supported by the medium supporting unit.

4. The medium supporting unit according to claim 1, wherein the holding portion rotates relative to the supporting portion about a base rotate axis that is located at a second portion-side, and the weight of the second portion is larger than the weight of the first portion.

5. A recording apparatus comprising:

the medium supporting unit according to claim 4; and a recording portion that performs recording on a medium that is in a state of being supported by the medium supporting.

6. The medium supporting unit according to claim 1, wherein the holding portion is hitched to the supporting portion at a second portion-side and rotates relative to the supporting portion about a base rotate axis that is located at a position of the hitch.

7. A recording apparatus comprising:

the medium supporting unit according to claim 6; and a recording portion that performs recording on a medium that is in a state of being supported by the medium supporting unit.

8. The medium supporting unit according to claim 1, wherein the holding portion is fixed to the supporting portion at a second portion-side so as to be rotatable relative to the supporting portion.

9. A recording apparatus comprising:

the medium supporting unit according to claim 8; and a recording portion that performs recording on a medium that is in a state of being supported by the medium supporting unit.

10. The medium supporting unit according to claim 1, wherein a portion having a larger weight out of the first portion and the second portion has a larger volume than a portion having a smaller weight out of the first portion and the second portion.

11. A recording apparatus comprising:

the medium supporting unit according to claim 10; and a recording portion that performs recording on a medium that is in a state of being supported by the medium supporting unit.

12. The medium supporting unit according to claim 1, wherein a portion having a larger weight out of the first portion and the second portion contains a portion having a larger specific gravity than a specific gravity of a portion having a smaller weight out of the first portion and the second portion.

13. A recording apparatus comprising:

the medium supporting unit according to claim 12; and a recording portion that performs recording on a medium that is in a state of being supported by the medium supporting unit.

14. The medium supporting unit according to claim 1, wherein the holding portion includes a weight whose location on the holding portion is changeable, and a portion which is one of the first portion and the second portion and at which the weight is located constitutes a portion having a larger weight out of the first portion and the second portion.

15. A recording apparatus comprising:

the medium supporting unit according to claim 14; and a recording portion that performs recording on a medium that is in a state of being supported by the medium supporting unit.

16. A recording apparatus comprising:

the medium supporting unit according to claim 1; and a recording portion that performs recording on a medium that is in a state of being supported by the medium supporting unit.

17. A medium supporting method for a medium supporting unit including a tray shaped supporting portion that supports a medium and a holding portion that holds the medium that is in a state of being supported by the supporting portion, the medium supporting method comprising: supporting the medium by the supporting portion including the holding portion provided with a first portion that is a portion at one side of a straight line passing through a center of the holding portion in a plan view of the holding portion, and a second portion that is a portion at the another side of the straight line, a weight of the first portion being different from a weight of the second portion, wherein the holding portion is a frame member that surrounds the supporting portion when the medium is in the state of being supported by the supporting medium.

* * * * *